United States Patent [19]

Bar-on

[11] 4,008,955

[45] Feb. 22, 1977

[54] FUSER ASSEMBLY FOR AN ELECTROPHOTOGRAHIC COPYING MACHINE

[75] Inventor: Ari Bar-on, Rochester, N.Y.

[73] Assignee: Xerox Corporation, Stamford, Conn.

[22] Filed: May 12, 1975

[21] Appl. No.: 576,815

[52] U.S. Cl. ..... 355/3 R; 219/216; 432/60

[51] Int. Cl.[2] ..... G03G 15/00; F27B 9/28

[58] Field of Search ..... 355/3 R, 3 FU; 219/216; 432/60, 228

[56] References Cited

UNITED STATES PATENTS

| | | | |
|---|---|---|---|
| 3,794,417 | 2/1974 | Machmer | 355/3 R |
| 3,797,127 | 3/1974 | Yamada et al. | 432/60 X |
| 3,846,151 | 11/1974 | Roteman et al. | 335/3 UX |
| 3,884,623 | 5/1975 | Slack | 219/216 X |
| 3,904,354 | 9/1975 | Moser | 432/60 |

*Primary Examiner*—Fred L. Braun
*Attorney, Agent, or Firm*—J. J. Ralabate; C. A. Green; H. Fleischer

[57] ABSTRACT

A fusing apparatus in which particles are affixed substantially permanently to a moving sheet of support material. Each portion of the leading marginal region of the sheet of support material is advanced substantially simultaneously between a fuser roll and a backup roll. As the sheet a support material passes between the fuser roll and backup roll, the side marginal regions thereof advance at a greater velocity than the central region. In this manner, a force component substantially normal to the path of movement of the sheet of support material in the plane thereof, is applied thereto preventing wrinkling.

8 Claims, 5 Drawing Figures

FUSER ASSEMBLY FOR AN ELECTROPHOTOGRAHIC COPYING MACHINE

BACKGROUND OF THE INVENTION

This invention relates generally to a fusing apparatus employed in an electrophotographic printing machine, and more particularly concerns preventing wrinkling of the sheet of support material as it passes through the fusing apparatus.

In a typical electrophotographic printing machine, a photoconductive surface is charged to a substantially uniform level. Thereafter, the charged portion of the photoconductive surface is exposed to a light image of an original document. The irradiated area of the photoconductive surface is selectively discharged recording an electrostatic latent image thereon. The electrostatic latent image corresponds to the informational areas contained in the original document. Heat settable particles are attracted to the electrostatic latent image during development forming a powder image corresponding thereto on the photoconductive surface. A sheet of support material is then positioned closely adjacent to the powder image and the particles are transferred from the photoconductive surface thereto in image configuration. The particles are then permanently affixed to the sheet of support material forming a copy of the original document thereon. In general, all types of electrostatographic printing, which include both electrophotographic and electrographic printing, utilizes some form of fusing particles to the sheet of support material. However, in the present application, an electrophotographic printing machine will be described as exemplary of the class of electrostatographic printing machines employing such an apparatus.

Various techniques have been developed for applying heat to the particles on the sheet of support material. One approach is to pass the sheet of support material with the powder image thereon through a pair of opposed rollers. In a system of this type, a heated fuser roll and a non-heated backup roll are employed. Preferably, the heated fuser roll has the outer surface thereof covered with a polytetrafluoroethylene coating, sold under the trademark Teflon, to which a release agent, such as silicone oil is applied. An alternate approach has been to utilize a bare metal heated roll which has a low molecular weight polyethylene applied thereto as a release agent.

Hereinbefore, various techniques have been devised to advance the sheet of support material into the nip between the heated fuser roll and backup roll without the resultant fused copy having wrinkles therein. One technique heretofore utilized to prevent wrinkling has been to taper the ends of the fuser roll. However, this poses some difficulties in the manufacture of the rolls.

Accordingly, it is a primary object of the present invention to improve the fusing apparatus by minimizing wrinkles in the sheet of support material as it passes therethrough.

BRIEF SUMMARY OF THE INVENTION

Briefly stated, and in accordance with the present invention, there is provided a fusing apparatus for permanently affixing particles to a sheet of support material.

Pursuant to the features of the present invention, the fusing apparatus includes a heated fuser roll and a backup roll in contact therewith. The sheet of support material passes between the fuser roll and backup roll with the particles thereon contacting the fuser roll. Means, positioned prior to the fuser roll in the path of movement of the sheet of support material, interpose each portion of the lead marginal region of the sheet of support material substantially simultaneously between the fuser roll and backup roll. Means are provided for advancing the side marginal regions of the sheet of support material at a greater velocity than the central region thereof as the sheet of support material passes between the fuser roll and backup roll. In this way, a force component is applied to the sheet of support material in a direction substantially normal to the path of movement of the sheet of support material in the plane thereof.

BRIEF DESCRIPTION OF THE DRAWINGS

Other objects and advantages of the present invention will become apparent upon reading the following detailed description and upon reference to the drawings, in which.

While the present invention will be hereinafter described in connection with a preferred embodiment thereof, it will be understood that it is not intended to limit the invention to that embodiment. On the contrary, it is intended to cover all alterntaives, modifications and equivalents as may be included within the spirit and scope of the invention as defined by the appended claims.

BRIEF DESCRIPTION OF THE INVENTION

Figure 1:
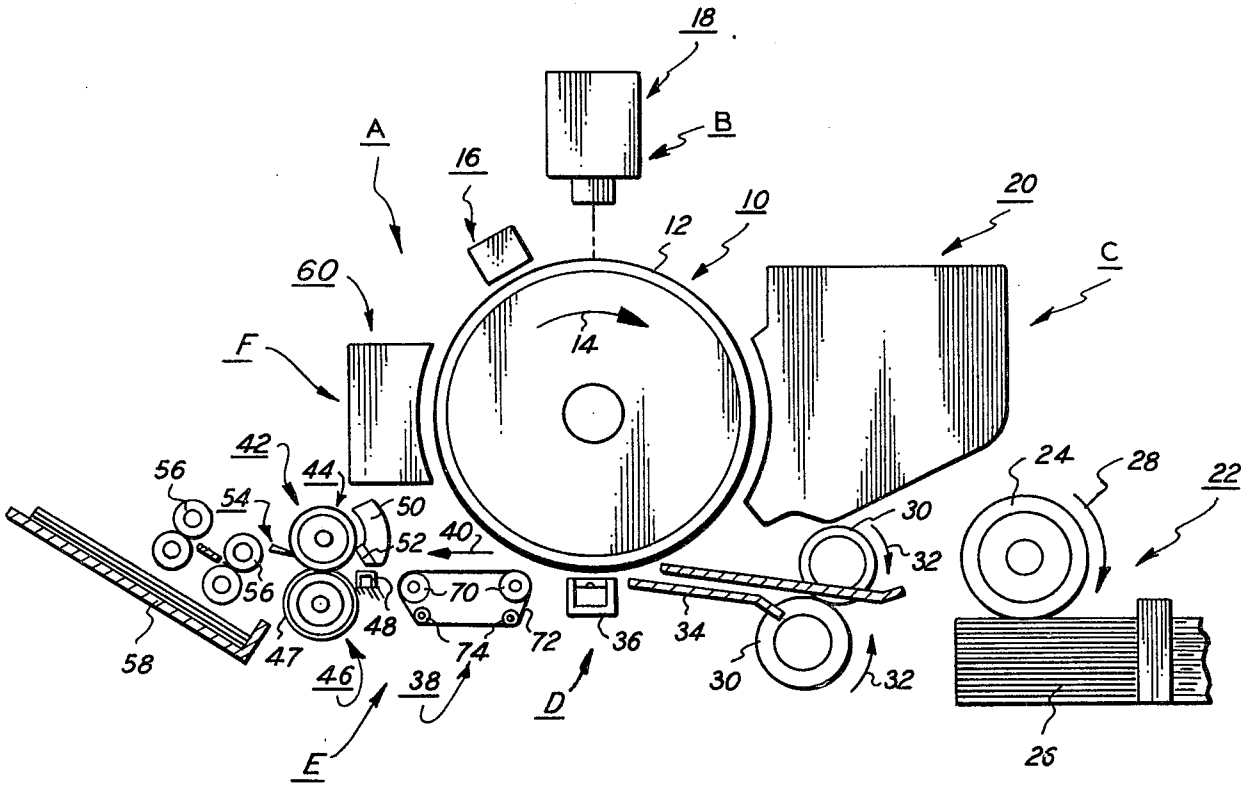
FIG. 1 is a schematic elevational view of an electrophotographic printing machine incorporating the features of the present invention therein.

FIG. 1 depicts an electrophotographic printing machine incorporating the features of the present invention therein. In the drawings, like reference numerals have been employed throughout to designate like elements. The apparatus of the present invention insures that the sheet of support material passing through the fusing device contains no wrinkles therein. Though this apparatus is particularly well adapted for use in an electrophotographic printing machine, it should be evident from the following discussion that it is equally well suited for use in a wide variety of fusing devices and is not necessarily limited in its application to the particular embodiment shown herein.

Electrophotographic printing is well known in the art. As such, the various processing stations employed in the printing machine of FIG. 1 will be shown as blocks and their operation described briefly with reference thereto.

The electrophotographic printing machine of FIG. 1 employs a drum 10 having a photoconductive surface 12 entrained about and secured to the exterior circumferential surface thereof. Drum 10 rotates in the direction of arrow 14, thereby moving photoconductive surface 12 through the various processing stations disposed about the periphery thereof. Preferably, photoconductive surface 12 is made from a selenium alloy of the type described in U.S. Pat. No. 2,970,906 issued to Bixby in 1961.

Initially, the drum 10 rotates photoconductive surface 12 through charging station A. Charging station A has a corona generating device, indicated generally by the reference numeral 16, positioned closely adjacent to photoconductive surface 12. A suitable corona generating device is described in U.S. Pat. No. 2,836,725 issued to Vyverberg in 1958. Corona generating device 16 charges photoconductive surface 12 to a relatively high substantially uniform potential level.

Thereafter, the charged portion of photoconductive surface 12 rotates through exposure station B. Exposure station B includes an exposure mechanism, indicated generally by the reference numeral 18. Exposure mechanism 18 comprises a transparent platen upon which the original document is positioned. Scan lamps illuminate the original document and the light rays reflected therefrom pass through a lens forming a light image thereof. Scanning of the original document is achieved by oscillating a mirror in a timed relationship with the rotation of drum 10, or, in lieu thereof, by moving the lamp and lens system across the original document so as to form a flowing light image thereof. The light rays transmitted from the original document are reflected through a lens forming a light image which, in turn, may be projected by a mirror through a slit in an apertured plate onto the charged portion of photoconductive surface 12. Irradiation of the charged portion of photoconductive surface 12 selectively dissipates the charge in accordance with the light intensity transmitted thereto. This records an electrostatic latent image on photoconductive surface 12 corresponding to the informational areas contained in the original document.

Next, drum 10 rotates the electrostatic latent image recorded on photoconductive surface 12 to development station C. At development station C, a developer unit 20 having a housing with a supply of developer mix therein, renders the electrostatic latent image visible. The developer mix generally comprises carrier granules having toner particles adhering thereto. These carrier granules are formed from a ferromagnetic material while the toner particles are usually made from a heat settable plastic. Preferably, developer unit 20 is a magnetic brush system. In such a system, a chain-like array of developer mix contacts the electrostatic latent image recorded on photoconductive surface 12. The latent image attracts electrostatically the toner particles from the carrier granules forming a toner powder image on photoconductive surface 12.

Prior to continuing with the remaining processing stations, the sheet feeding path will be briefly described. With continued reference to FIG. 1, a sheet of support material is advanced by sheet feeding apparatus 22 to transfer station D. Sheet feeding apparatus 22 includes a feed roller 24 contacting the uppermost sheet of a stack of sheets of support material 26. Feed roller 24 rotates in the direction of arrow 28 to advance successive uppermost sheets from stack 26 into the nip between register rolls 30. Register rolls 30 rotate in the direction of arrow 32 to align and forward the advancing sheet of support material into chute 34. Chute 34 directs the advancing sheet of support material into contact with photoconductive surface 12, in registration with the toner powder image formed thereon. In this manner, the sheet of support material is moved into contact with the toner powder image on photoconductive surface 12 at transfer station D.

Transfer station D includes a corona generator device 36. Corona generator device 36 applies a spray of ions onto the side of the sheet of support material opposed from photoconductive surface 12. The toner powder image adhering to photoconductive surface 12 is then attracted therefrom to the surface of the sheet of support material in contact therewith. After transferring the toner powder image to the sheet of support material, endless belt conveyor 38 advances the sheet of support material in the direction of arrow 40 to fixing station E.

Fixing station E includes a fuser assembly, indicated generally by reference numeral 42. Fuser assembly 42 heats the transferred toner powder image to permanently affix it to the sheet of support material. Preferably, fuser assembly 42 includes a heated fuser roll 44 in contact with a backup roll 46. The sheet of support material on conveyor 38 is advanced in the direction of arrow 40 over a plurality of opposed, spaced support members 48. Support members 48 extend in an upwardly direction substantially normal to the path of movement of the sheet of support material, as indicated by arrow 40. The lead marginal region of the sheet of support material engage support members 48. In this way, each portion of the lead marginal region of the sheet of support material is advanced into the nip defined by backup roll 46 and fuser roll 44 substantially simultaneously. A pair of opposed, spaced rings 47 secured to backup roll 46 engage the side marginal regions of the sheet of support material. The contact area in the side marginal regions is greater than in the central region as the sheet of support material passes through the nip. In this manner, the velocity of the side marginal regions is greater than the central regions of the sheet of support material. This results in a force component being applied to the sheet of support material in a direction substantially normal to the path of movement thereof. The force is in a plane defined by the sheet of support material. The structure of this apparatus will be described hereinafter in greater detail with reference to FIGS. 2 and 3. The sheet of support material with the toner powder image thereon is interposed between fuser roll 44 and backup roll 46 with the toner powder image contacting fuser roll 44.

Release material applicator 50 periodically applies release material to fuser roll 44. Blade 52 contacting fuser roll 44 adjusts the thickness of the layer of release material applied thereto. The release material insures that the toner powder image does not stick to fuser roll 44. The details of this apparatus will be described hereinafter with reference to FIG. 4.

After the toner powder image has been permanently affixed to the sheet of support material, sheet stripping apparatus 54 separates the sheet of support material therefrom. Stripping apparatus 54 will be described hereinafter in greater detail with reference to FIG. 5. The sheet of support material is then advanced by a series of rolls 56 to catch tray 58 for subsequent removal therefrom by the machine operator.

Invariably, after the sheet of support material is separated from photoconductive surface 12 at transfer station D, residual toner particles adhere to photoconductive surface 12. These residual toner particles are removed from photoconductive surface 12 at cleaning station F. Cleaning station F includes a cleaning apparatus, indicated generally by the reference numeral 60. Generally, cleaning apparatus 60 includes a corona generating device and a brush. The corona generating device neutralizes the remaining electrostatic charge on photoconductive surface 12 and the charge of the residual toner particles adhering thereto. After the charge on both photoconductive surface 12 and the toner particles is substantially neutralized, the brush, in contact therewith, rotates to remove the toner particles therefrom. Subsequent to cleaning, a discharge lamp floods photoconductive surface 12 with light to dissipate any residual electrostatic charge remaining thereon. This insures that photoconductive surface 12 is returned to its initial charge level prior to be charged for the next successive imaging cycle.

It is believed that the foregoing description is sufficient for purposes of the present application to illustrate the general operation of an electrophotographic printing machine incorporating the features of the present invention therein.

Figure 2:
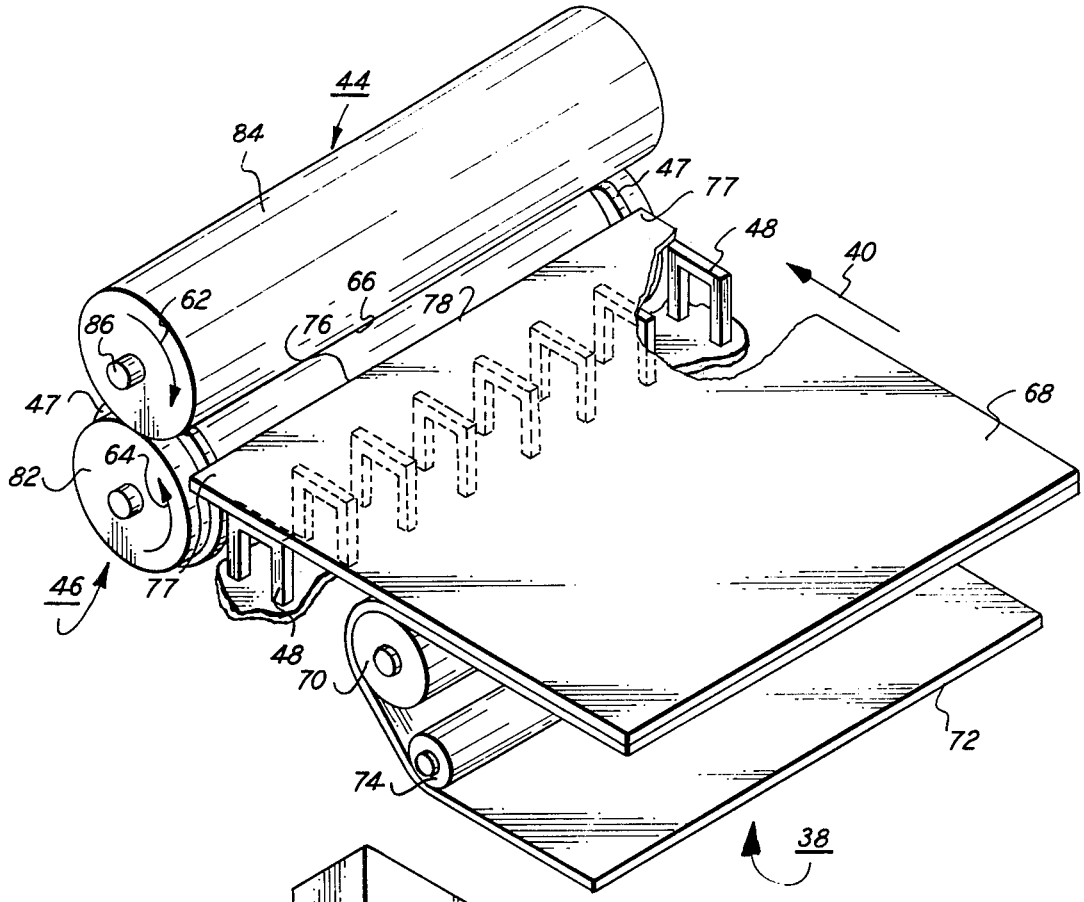
FIG. 2 is a schematic perspective view depicting the sheet support members used in the fusing apparatus of the FIG. 1 printing machine fuser.

Referring now to the specific subject matter of the present invention, FIG. 2 depicts the fusing apparatus and the associate support members for guiding the sheet of support material into the nip between fuser roll 44 and backup roll 46 in greater detail. Fuser roll 44 rotates in the direction of arrow 62, while backup roll 46 rotates in the direction of arrow 64. At contact point 66, a nip is defined through which sheet 68 passes. Conveyor 38 employs an endless belt 72 entrained about a pair of opposed spaced rollers 70. Guide rollers 74 provide sufficient tension in the belt 72 to permit roller 70 to advance the belt in the direction of arrow 40. Sheet 68 is disposed on belt 72 so as to be advanced thereby in the direction of arrow 40. As sheet 68 approaches nip 66, interposing means or support members 48 engage the lead marginal region 76 thereof. Support members 48 guide each portion of lead marginal region 76 of sheet 68 into nip 66 substantially simultaneously. As sheet 68 passes through nip 66, rings 47 secured to backup roll 46 engage side marginal regions 77 of sheet 68. Rings 47 are integral with backup roll 46 at either side marginal region thereof and being substantially concentric therewith. The outer diameters of rings 47 are greater than the outer diameter of backup roll 46. Thus, in nip 66, the contact area between rings 47 and fuser roll 44 is greater than the contact area between backup roll 46 and fuser roll 44. This results in velocity of side marginal regions 77 being greater than central region 78 producing a force component on sheet 68 substantially normal to the direction of movement thereof and in a plane defined by sheet 68, as indicated by arrow 40. This prevents wrinkling of sheet 68 as it passes between fuser roll 44 and backup roll 46. Support members 48 are mounted stationarily on the machine frame prior to fuser roll 44. The support members engage each portion of the lead marginal region of sheet 68. This insures that each portion of the lead marginal region of sheet 68 passes substantially simultaneously into nip 66.

Figure 3:
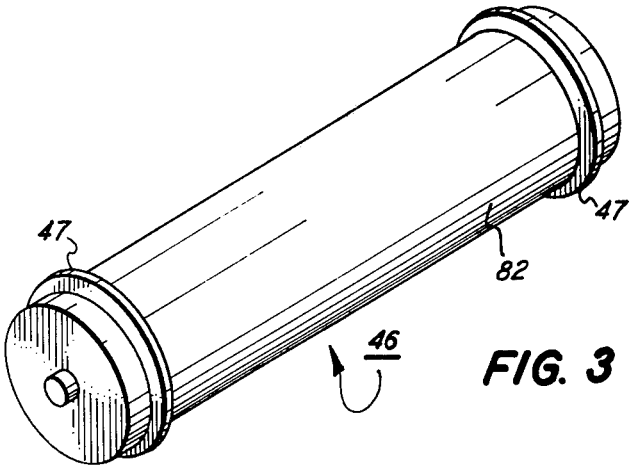
FIG. 3 is a schematic perspective view depicting the backup roll employed in the fusing apparatus of the FIG. 1 printing machine.

Turning now to FIG. 3, rings 47 are integral with backup roll 46. One ring is secured to backup roll 46 at one marginal region thereof. The other ring is secured to the other marginal region of backup roll 46. Rings 47 are mounted concentrically on backup roll 46 with their centers being substantially in coincidence. The outer diameter of rings 47 is greater than the outer diameter of backup roll 46.

Figure 4:
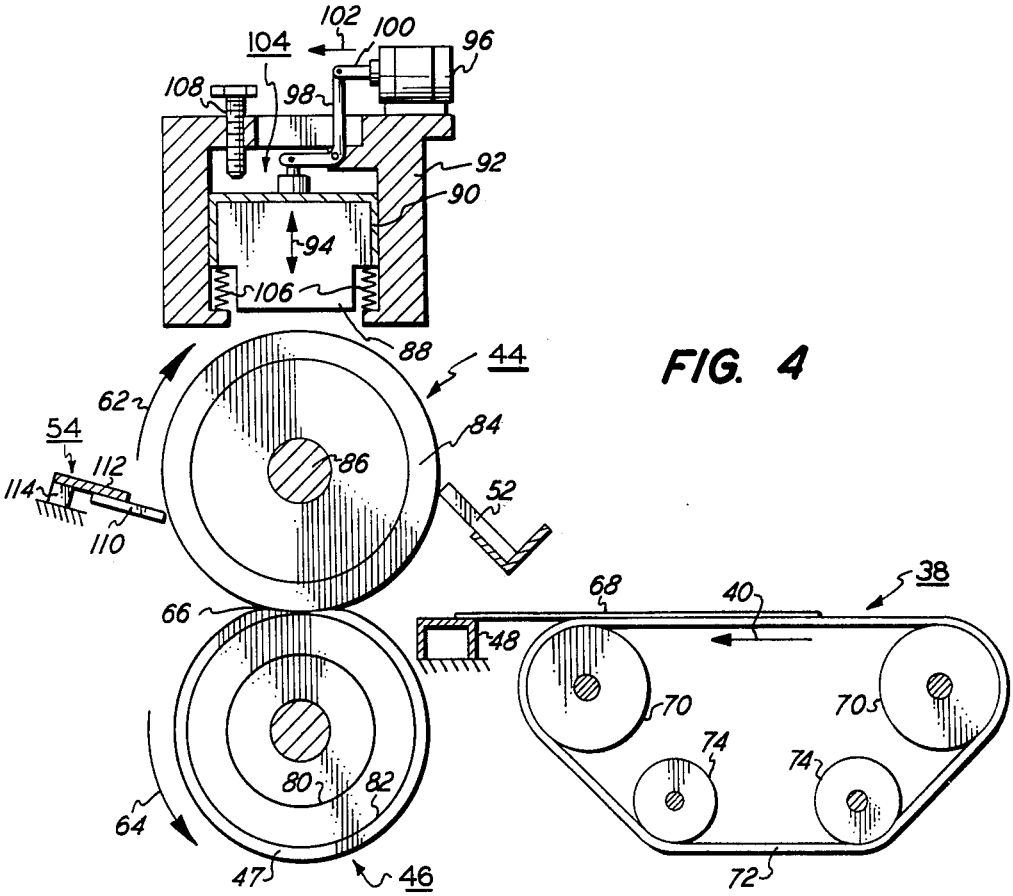
FIG. 4 is a schematic elevational view showing the release material applicator employed in the fusing apparatus of the FIG. 1 printing machine fuser.

Referring now to FIG. 4, fuser assembly 42 includes a heated fuser roller 44 and a backup roll 46. Fuser roll 44 contacts backup roll 46 to define a nip through which sheet 68 passes. Sheet 68 is orientated so the toner powder image thereon contacts fuser roll 44. A channel-shaped base (not shown) is provided for supporting fuser assembly 42 in the electrophotographic printing machine shown in FIG. 1. Backup roll 46 is mounted rotatably on a pair of brackets secured to the channel-shaped base by means of a right angle bracket. Preferably, backup roll 46 includes a rigid steel core or shaft 80 having a Viton elastomeric surface or layer 82 disposed thereover and affixed thereto. Shaft 80 is secured rotatably on brackets by a pair of bearings secured thereto by retaining rings. By way of example, backup roll 46 has a 0.1 inch thick layer of Viton or other suitable high temperature elastomeric material thereon. Other suitable materials are, for example, fluorosilicone or a silicone rubber. Backup roll 46 is, preferably, 15 & inches long to accomodate various widths of support material.

A pair of brackets (not shown) of a generally E-shaped configuration are provided for mounting fuser roll 44 rotatably in fuser assembly 42. To this end, a pair of ball bearings mounted in each of the support brackets provide a rotatable support. The bearings are retained in the brackets by means of retaining rings. A pair of end caps are secured to a hollow cylinder or core 84 forming a part of fuser roll 44. A heating element 86 is supported internally of cylinder 84 providing thermal energy to cylinder 84 heating it to the operating temperatures thereof. Heating element 86 develops sufficient heat to elevate the surface temperature of cylinder 84 to the operational temperature thereof, i.e. from about 285*L*F to about 295*L*F. By way of example, heating element 86 may include a quartz enevelope having a tungsten resistance heating element disposed therein. Preferably, cylinder 84 is fabricated from any suitable material capable of efficiently conducting heat to the external surface thereof. For example, suitable materials are aluminum and alloys thereof, steel, stainless steel, nickel and nickel alloys thereof, nickel plated copper, chromium plated copper, and alloys thereof. Preferably, fuser roll 44 is equal in length to backup roll 46. Fuser roll 44 requires about 420 watts peak power with the average power being about 320 watts, and about 100 watts being required for standby operation. Heating element 86 is supported internally of cylinder 84 and electrically coupled to a suitable power supply for the energization thereof. Cylinder 84 is fabricated from a material having a relatively high surface energy. Toner material, in contact therewith, readily wets the surface, and is difficult to remove therefrom. Accordingly, there is provided a release material applicator 50 for applying release material to cylinder 84. The material is, preferably, a low molecular weight substance which is a solid at room temperature and has a relative low viscosity at the operating temperature of cylinder 84. An example of such a material is polyethylene manufactured by Allied Chemical Company and having a designation AC-8 homopolymer.

With continued reference to FIG. 4, a solid bar of polyethylene 88 is mounted in an open-ended housing 90. Housing 90 is mounted slidably in frame 92 so as to reciprocate in the direction of arrow 94. Solenoid 96 is coupled to housing 90 through pivot arm 98. Energization of solenoid 96 moves arm 100 in the directin of arrow 102. This pivots arm 98 in the direction of arrow 104, moving housing 90 in a downwardly direction compressing springs 106. In the extreme downward position, polyethylene bar 88 contacts fuser roll 44 applying release material thereto. After polyethylene bar 88 has been in contact with fuser roll 44 a suitable duration of time, solenoid 96 is de-energized and springs 106, which have been previously compressed, move housing 90 and polyethylene bar 88 in an upwardly direction until housing 90 engages stop 108. Stop 108 is adjustable to position polyethylene bar 88 the requisite distance from fuser roll 44 when not in contact therewith. Reciprocating motion of polyethylene bar 88 is controlled by actuation of solenoid 96, which, in turn, is regulated by the machine logic. The detailed structural assembly of release applicator 50 is described in copending application Ser. No. 551, 214 filed on Feb. 20, 1975, now U.S. Pat. No. 3,941,085, the relevant portions thereof being hereby incorporated into the present application.

Support material 68, as it passes through nip 66, tends to adhere to fuser roll 44. Sheet stripping is achieved by a stripping apparatus 54 having a blade member 110 contacting fuser roll 44. Blade member 110 is secured to a Z-shaped bracket 112 which is mounted by means of leaf springs 114 to the machine frame. The detailed structure of sheet stripping apparatus 54 will be described hereinafter with reference to FIG. 5.

Figure 5:
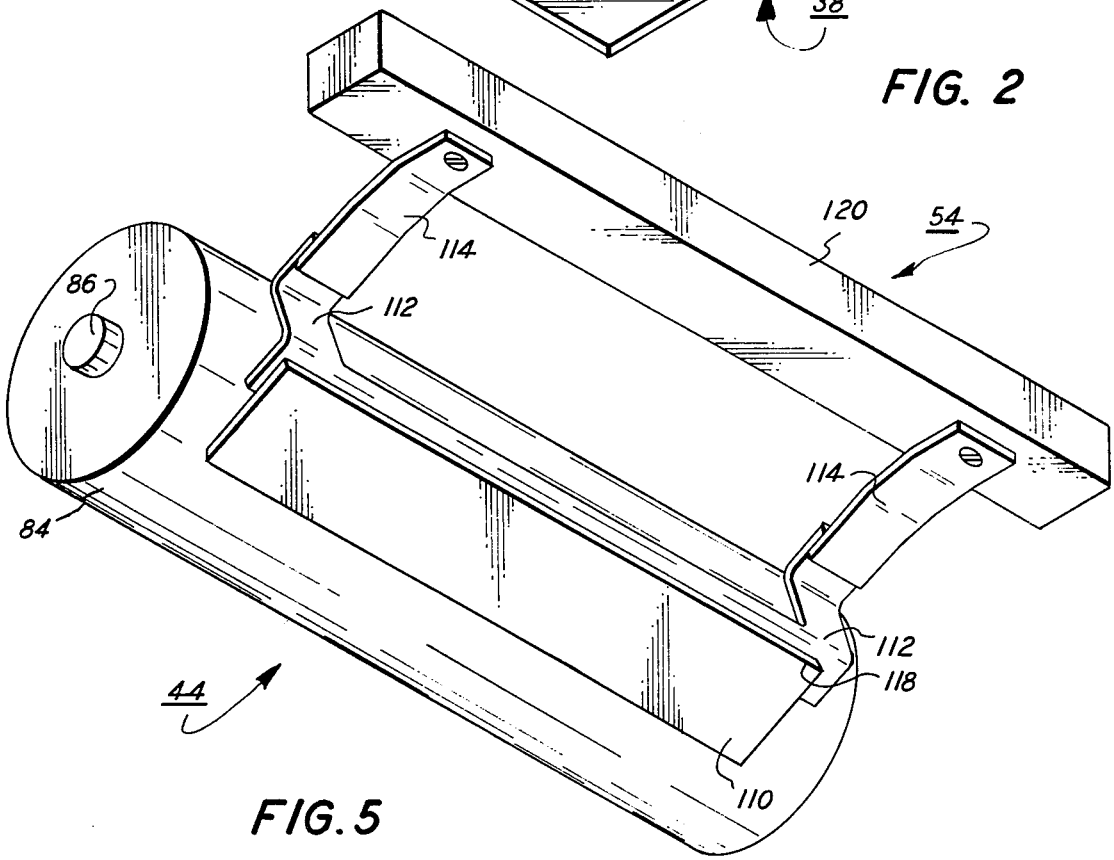
FIG. 5 is a schematic perspective view illustrating the sheet separator used in the fusing apparatus of the FIG. 1 printing machine.

As shown in FIG. 5, blade 110 has the leading marginal edge portion 116 thereof contacting fuser roll 44. Trailing marginal edge 118 of blade member 110 is secured to Z-shaped bracket 112. A pair of spaced opposed leaf springs 114 have the leading marginal edge portion thereof secured to Z-shaped bracket 112. The trailing marginal portion of leaf springs 114 are secured to a support member 120 integral with the electrophotographic printing machine. Preferably, blade member 110 is made from a thin sheet of stainless steel. Leaf spring 114 is also made, preferably, from spring steel. Similarly, bracket 112 may be made from any suitable steel. A detailed description of sheet stripping apparatus 54 will be found is copending application Ser. No. 540,640 filed on Jan. 13, 1975, now U.S. Pat. No. 3,955,916, the relevant portions thereof being hereby incorporated into the present application.

In recapitulation, the apparatus of the present invention advances each portion of the leading marginal edge portion of the sheet of support material into the nip between the fuser roll and backup roll substantially simultaneously. A pair of rings on opposed side marginal regions of the backup roll and extending outwardly therefrom advance the side marginal regions of the sheet through the nip at a greater velocity than the central region thereof. This applies a force component substantially normal to the path of movement of the sheet of support material in the plane thereof preventing wrinkling as it passes through the nip.

It is, therefore, evident that there has been provided, in accordance with the present invention, an apparatus for permanently affixing a toner powder image to a sheet of support material without introducing any wrinkles therein. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A fusing apparatus for permanently affixing particles to a moving sheet of support material, including:

a heated fuser roll;

a backup roll in contact with said fuser roll to define a nip through which the sheet of support material passes with the particles contacting said fuser roll;

means for conveying the sheet of support material toward the nip defined by said fuser roll and said backup roll;

a plurality of opposed, spaced support members located between said conveying means and said fuser roll, said support members extending in an upwardly direction substantially normal to the path of movement of the sheet of support material in engagement therewith and extending across the sheet of support material in a direction substantially normal to the path of movement thereof; and means for advancing the side marginal regions of the sheet of support material at a greater velocity than the central region thereof as the sheet of support material passes between said fuser roll and said backup roll so as to apply a force component thereon substantially normal to the path of movement of the sheet of support material in a plane defined by the sheet of support material preventing wrinkling thereof.

2. An apparatus as recited in claim 1, wherein said advancing means includes a pair of opposed spaced rings, one of said rings being secured to one side marginal region of said backup roll and the other of said rings being secured to the other side marginal region of said backup roll, said pair of rings being mounted concentrically with said backup roll and the outer diameter of said rings being greater than the outer diameter of said backup roll so that the contact area between said rings and said fuser roll is greater than the contact area being said backup roll and said fuser roll.

3. An apparatus as recited in claim 2, further including:

a blade member; and means for resiliently urging the leading marginal edge portion of said blade member into contact with said fuser roll to separate the sheet of support material therefrom after the particles have been permanently fused thereto.

4. An apparatus as recited in claim 3, further including means for applying a coating of release material to said fuser roll facilitating the separation of the sheet of support material therefrom.

5. An electrophotographic printing machine, including:

a photoconductive member;

means for charging said photoconductive member to a substantially uniform level;

means for exposing the charged portion of said photoconductive member to a light image of an original document recording thereon an electrostatic latent image corresponding to the original document;

means for developing the electrostatic latent image with toner particles forming a toner powder image of the original document on said photoconductive member;

means for transferring the toner powder image from said photoconductive member to a sheet of support material; and a fusing apparatus for permanently affixing the toner particles to the sheet of support material, said fusing apparatus comprising a heated fuser roll, a backup roll in contact with the fuser roll to define a nip through which the sheet of support material passes with the particles contacting the fuser roll, means for conveying the sheet of support material toward the nip defined by the fuser roll and the backup roll, a plurality of opposed, spaced support members located between said conveying means and the fuser roll, said support members extending in an upwardly direction substantially normal to the path of movement of the sheet of support material in engagement therewith and extending across the sheet of support material in a direction substantially normal to the path of movement thereof, and means for advancing the side marginal regions of the sheet of support material at a greater velocity than the central region thereof as the sheet of support material passes between the fuser roll and the backup roll so as to apply a force component thereon substantially normal to the path of movement of the sheet of support material in a plane defined by the sheet of support material preventing wrinkling thereof.

6. a printing machine as recited in claim 5, wherein the advancing means of said fusing apparatus includes a pair of opposed, spaced rings, one of said rings being secured to one side marginal region of the backup roll and the other of said rings being secured to the other side marginal region of the backup roll, the pair of rings being mounted concentrically with said backup roll and the outer diameter of the rings being greater than the outer diameter of the backup roll so that the contact area between the rings and the fuser roll is greater than the contact area between the backup roll and the fuser roll.

7. A printing machine as recited in claim 6, wherein said fusing apparatus further includes:

a blade member; and means for resiliently urging the leading marginal edge portion of said blade member into contact with the fuser roll to separate the sheet of support material therefrom after the toner particles have been permanently fused thereto.

8. A printing machine as recited in claim 7, wherein said fusing apparatus further includes means for applying a coating of release material to the fuser roll facilitating the separation of the sheet of support material therefrom.

* * * * *